US005829506A

United States Patent [19]

Zorbas

[11] Patent Number: 5,829,506

[45] Date of Patent: Nov. 3, 1998

[54] FABRIC BLIND SLAT

[76] Inventor: Tass Zorbas, Silverwood, Lot 51, Canns Road, Bedfordale, 6112, Western Australia, Australia

[21] Appl. No.: 793,037

[22] PCT Filed: Feb. 28, 1996

[86] PCT No.: PCT/AU96/00107

§ 371 Date: Feb. 13, 1997

§ 102(e) Date: Feb. 13, 1997

[87] PCT Pub. No.: WO97/06334

PCT Pub. Date: Feb. 20, 1997

[30] Foreign Application Priority Data

Aug. 8, 1995 [AU] Australia ..... PN4691

[51] Int. Cl.[6] ..... E06B 3/12

[52] U.S. Cl. ..... 160/236; 160/168.1 R

[58] Field of Search ..... 160/236, 166.1 R, 160/168.1 R, 176.1 R, 235

[56] References Cited

U.S. PATENT DOCUMENTS

| | | | |
|---|---|---|---|
| 341,744 | 11/1886 | Schaefer et al. . | |
| 372,828 | 8/1887 | Sticker . | |
| 2,074,482 | 3/1937 | Martens . | |
| 2,086,461 | 7/1937 | Bogen . | |
| 2,090,145 | 8/1937 | Pierce . | |
| 2,111,979 | 3/1938 | Lawson et al. . | |
| 2,156,163 | 4/1939 | Pierce . | |
| 2,187,121 | 1/1940 | Graves . | |
| 2,304,534 | 12/1942 | Burns | 160/236 X |
| 2,326,454 | 8/1943 | Gentile . | |
| 2,488,453 | 11/1949 | Vogel . | |
| 2,588,550 | 3/1952 | Martin et al. . | |

FOREIGN PATENT DOCUMENTS

| | | |
|---|---|---|
| 16919 | of 1947 | Australia . |
| B16357 | of 1983 | Australia . |
| 0628696 | 12/1994 | European Pat. Off. . |
| 114856 | 9/1993 | Sweden . |
| 439670 | 12/1967 | Switzerland . |

*Primary Examiner*—Blair Johnson
*Attorney, Agent, or Firm*—Bachman & LaPointe, P.C.

[57] ABSTRACT

The present invention relates to a fabric blind slat (10). The fabric blind slat (10) includes an elongated strip (12) of fabric characterised in that the strip of fabric (12) has at least one longitudinally extending pocket (14) on a longitudinal edge (16, 18) into which a relatively rigid support member (20) is insertable.

The present invention also relates to a fabric venetian blind assembly (30) and a method for the production of a fabric venetian blind assembly (30).

13 Claims, 5 Drawing Sheets

FABRIC BLIND SLAT

BRIEF DESCRIPTION OF THE INVENTION

The present invention relates to a fabric blind slat. In particular, the present invention relates to a fabric blind slat for venetian blinds.

FIELD OF THE INVENTION

Blinds for covering windows and other light transparent surfaces are available in a variety of different forms and materials depending on the particular visual appearance desired. The known items for controlling the amount of light through a transparent surface include venetian blinds, roller blinds and vertical blinds.

Fabric blinds are popular blinds for use in buildings and are extensively used in vertical blinds for their aesthetic appeal.

However, a problem exists for the use of fabric in horizontal blind slats since the fabric is not strong enough to lie in a horizontal plane without sagging. Hence, at the present time slats are usually made of metal and/or wood.

The present invention seeks to overcome the abovementioned problem.

SUMMARY OF THE INVENTION

In accordance with a first aspect of the present invention there is provided a fabric blind slat including an elongated strip of fabric characterised in that the strip of fabric has at least one longitudinally extending pocket on a longitudinal edge into which a relatively rigid support member is insertable.

In accordance with a second aspect of the present invention there is provided a fabric venetian blind assembly characterised by:

(a) a plurality of fabric blind slats including an elongated strip of fabric characterised in that the strip of fabric has at least one longitudinally extending pocket on a longitudinal edge into which a relatively rigid support member is insertable:

(c) connecting ladder ropes or connecting tape;

(d) venetian blind head box; and (e) one or more draw cords.

In accordance with a third aspect of the present invention there is provided a method for the assembly of a fabric venetian blind characterised by including the following steps:

(a) forming a fabric blind slat including an elongated strip of fabric characterised in that the strip of fabric has at least one longitudinally extending pocket on a longitudinal edge;

(b) inserting a relatively rigid support member into the said pocket; and (c) connecting the fabric blind slats by way of connecting ladder ropes or tape.

BRIEF DESCRIPTION OF THE DRAWINGS

The present invention will now be described, by way of example, with reference to the accompanying drawings; in which.

DESCRIPTION OF THE INVENTION

Figure 1A:
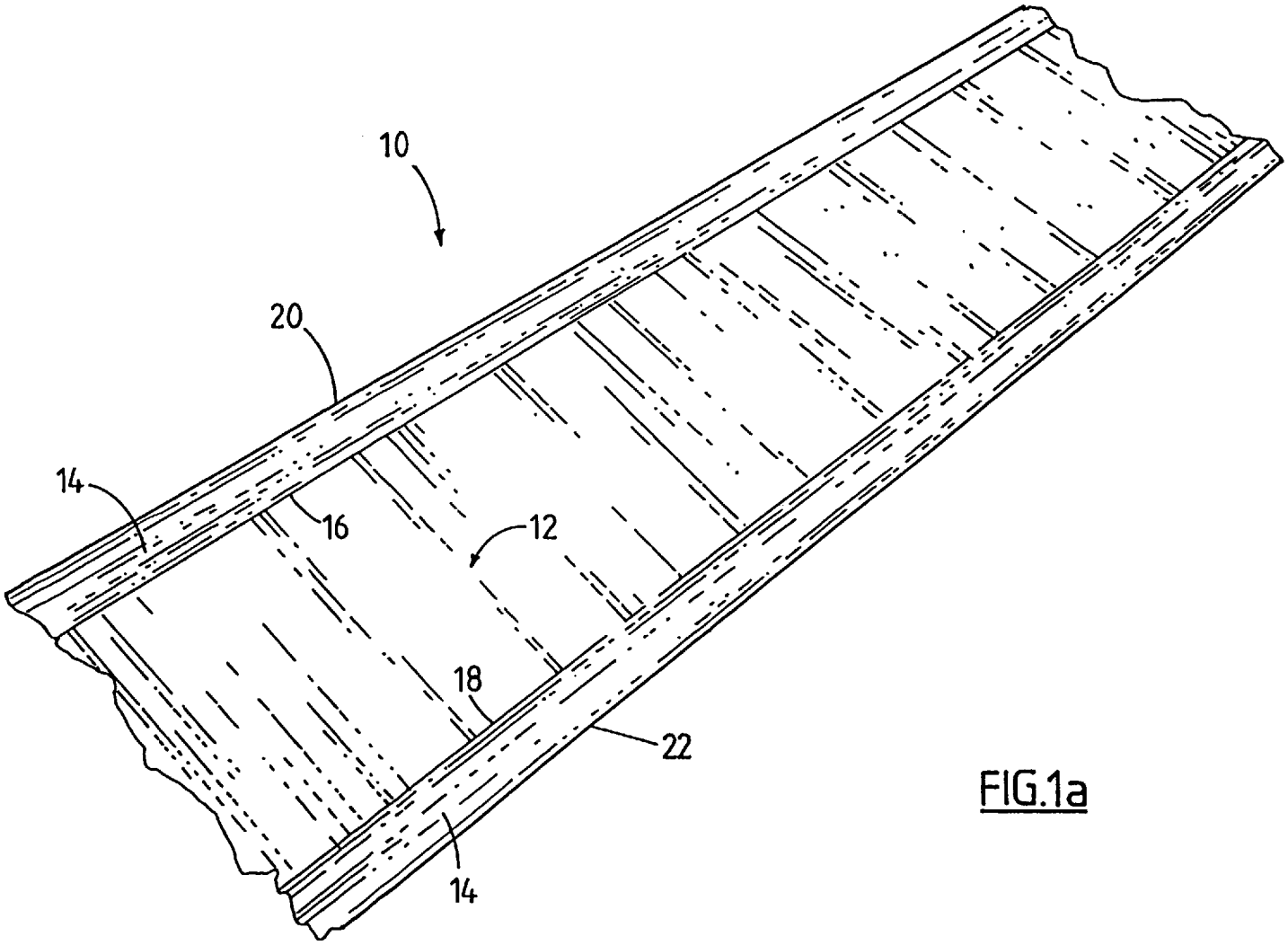
FIG. 1*a* is an upper perspective view of a fabric blind slat in accordance with the present invention.

There is shown in FIG. 1*a*, an upper perspective view of a fabric blind slat 10. The fabric blind slat 10 may be made from any suitable fabric including but not limited to polyester yarn, acrylic yarn, nylon, cotton, wool, polypropylene and any other fabric suitable for use in fabric blinds.

The fabric blind slat 10 includes an elongated central strip 12 of suitable fabric material. The slat 10 has a longitudinally extending pocket 14 at a first longitudinal edge 16 of the blind 10. Similarly, the slat 10 has a longitudinally extending pocket 14 at a second longitudinal edge 18 of the blind 10. The longitudinally extending pocket 14 is closed longitudinally at a first side 20 and a second side 22 as shown in FIG. 1.

Figure 1B:
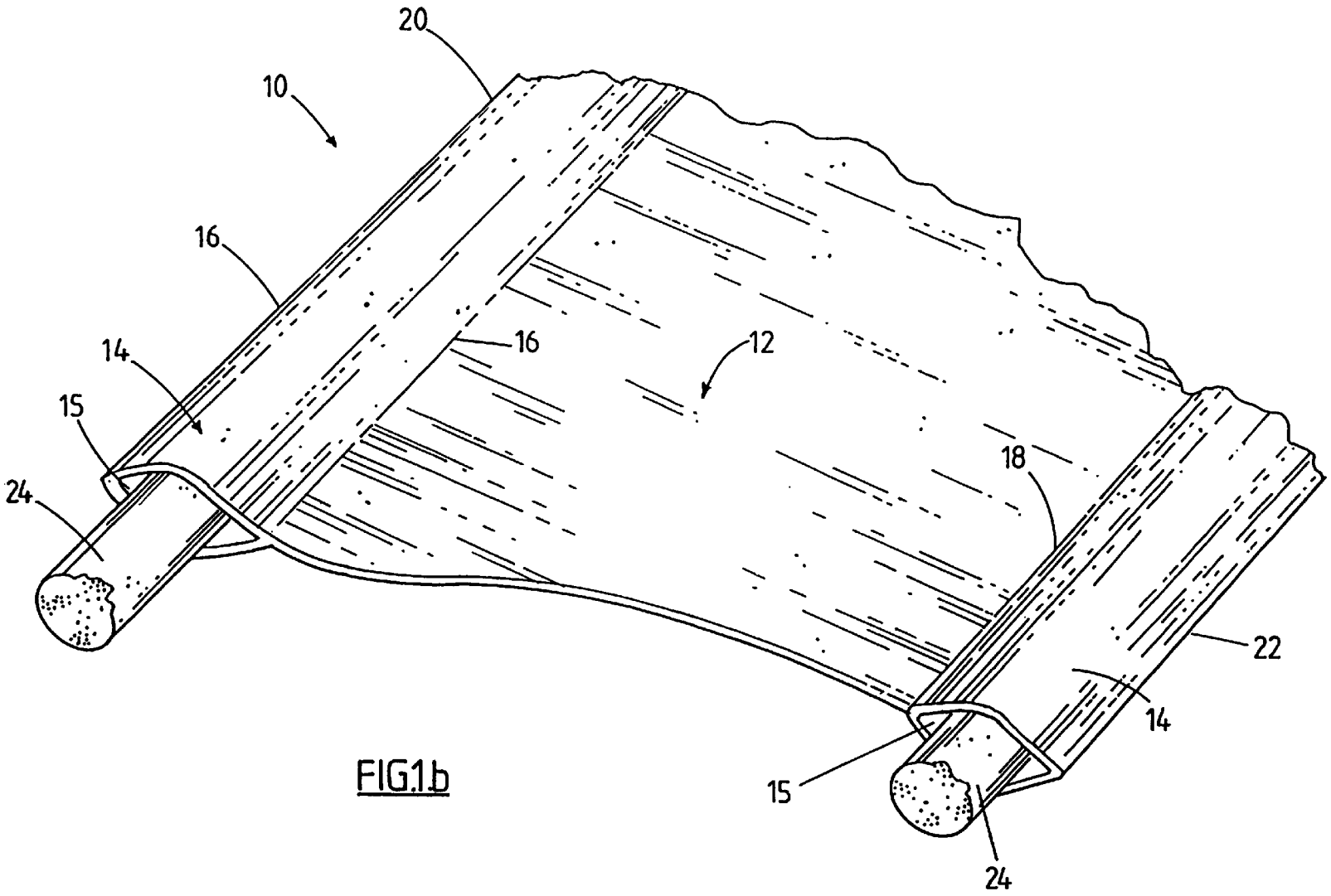
FIG. 1*b* is a partly cut away second upper perspective view of the fabric blind slat in accordance with the present invention.

There is shown in FIG. 1*b*, a partly cut away second upper perspective view of the fabric blind slat 10 having typically two longitudinally extending pockets 14. The pockets 14 have a longitudinally extending space 15 within the fabric blind slat 10. A support member 24 of relatively rigid material is inserted within the space 15 of the pockets 14.

Figure 1C:
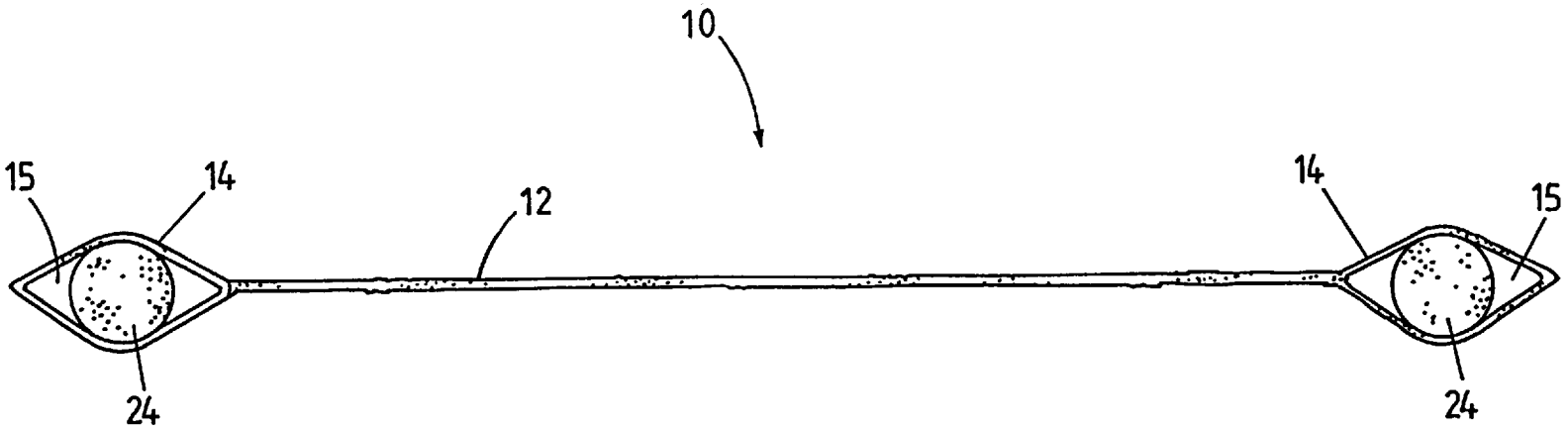
FIG. 1*c* is an end view of the fabric blind slat in accordance with the present invention.

This relatively rigid member 24 is typically a rod made from fibreglass, a plastics material such as PVC or, nylon, metal, wood, or any other suitable material to increase the strength and to provide support of the slat 10. Typically, the relatively rigid member 24 is also resilient. There is also shown in FIG. 1*c* an end view of the fabric blind slat 10. This end view shows the cross section of a preferred embodiment of the present invention. The central strip 12, longitudinally extending pockets 14, longitudinally extending space 15 and support member 24 are shown in this figure.

The slat 10 may also have one or more additional layers of suitable fabric material (not shown) in the central strip 12 and/or the longitudinally extending pockets 14. It is envisaged that a multi-layered fabric blind slat 10 would fall within the scope of the present invention.

Figure 2A:
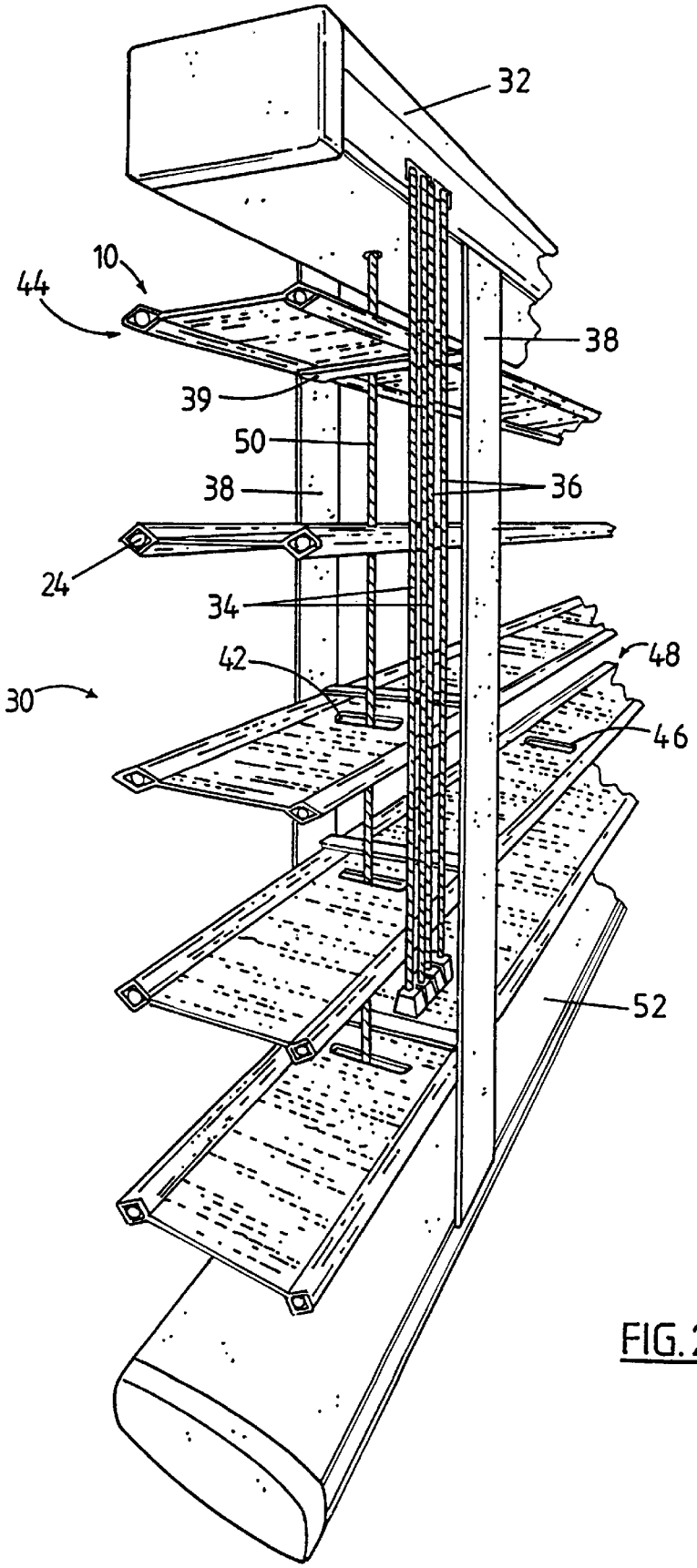
FIG. 2*a* is a perspective view of a first embodiment of a fabric venetian blind assembly in accordance with the present invention.
Figure 2B:
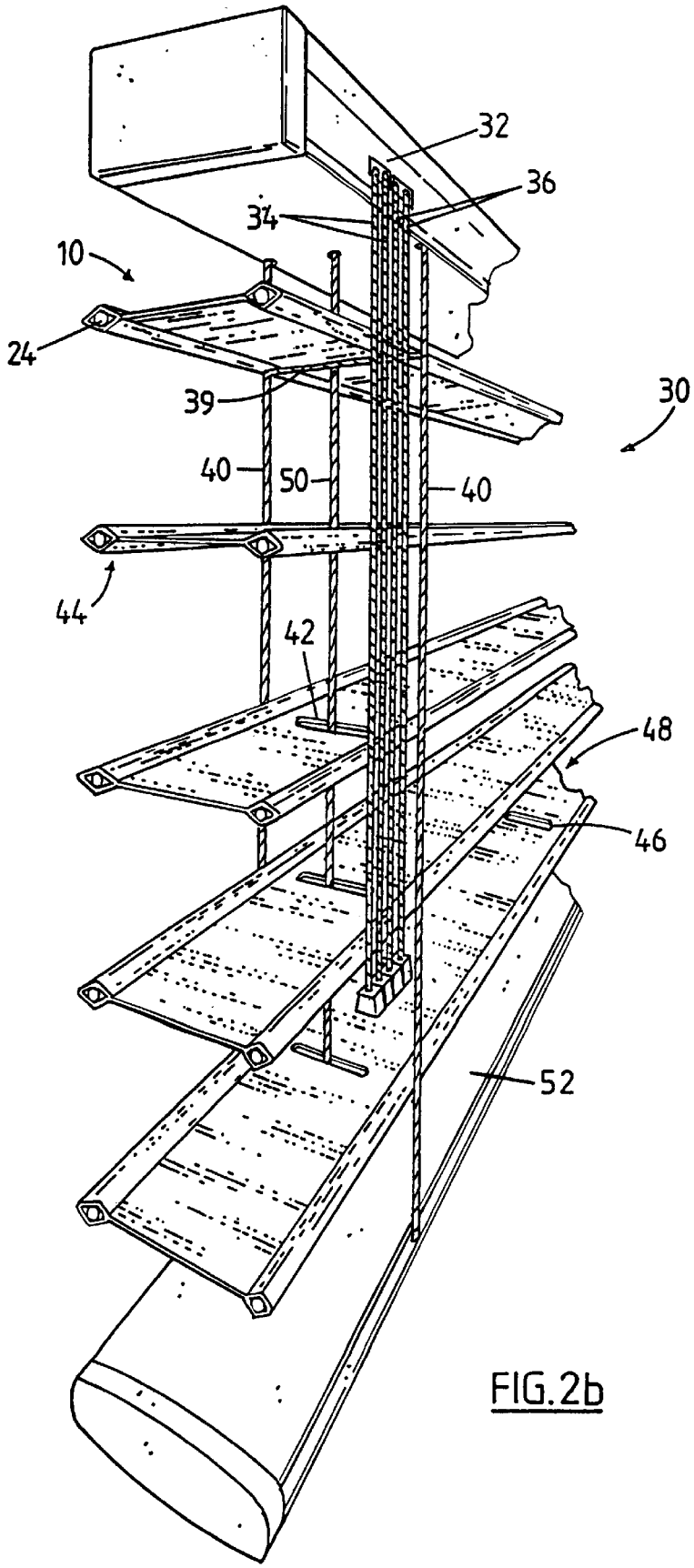
FIG. 2*b* is a perspective view of a second embodiment of a fabric venetian blind assembly in accordance with the present invention.

In FIGS. 2*a* and 2*b*, there is shown a perspective view of a venetian blind assembly 30 incorporating the fabric blind slat 10. The only difference between FIGS. 2*a* and 2*b* is that a connecting tape 38 is shown in FIG. 2*a* as a means to join the slats 10 at their longitudinal sides 20 and 22 respectively, instead of connecting ladder ropes 40 as shown in FIG. 2*b*. The connecting ladder ropes 40 include cross members 39 upon which a fabric blind slat is supported.

In FIGS. 2*a* and 2*b*, there is shown a venetian blind assembly 30. The assembly 30 includes a head box 32, two pairs of draw cords 34 and 36, connecting tape 38 (as shown in FIG. 2*a*) or first connecting ladder ropes 40 (as shown in FIG. 2*b*) which join the fabric blind slats 10 at their longitudinal sides 20 and 22 respectively, and a guard rail 52.

The fabric blind slats 10 include a first aperture 42 towards a front end 44. The fabric blind slats 10 also include a second aperture 46 towards a rear end 48. A pair of connecting ropes 50 extend from the headbox 32 through the apertures 42 and 46 and end in the guard rail 52 which is at a lower end of the venetian blind assembly 30.

The fabric blind slat 10 is made by weaving yarns of suitable fabric to form an elongated strip 12 of fabric material with integrally formed longitudinal pockets 14.

The longitudinally extending pockets 14 may also be formed by forming a hem on an elongated strip of fabric on either side, or both longitudinal edges 16 and 18.

A weaving apparatus such as an automatic narrow loom machine can be utilised to make the fabric blind slat of the present invention.

EXAMPLE

A high speed automatic narrow loom weaving machine that has the following specifications is utilised to make the fabric blind slat of the present invention.

| | |
|---|---|
| Maximum number of fabrics: | 4 |
| Reed width: | maximum of 65 mm |
| Maximum speed: | 1600 rpm |
| Pick density: | 3.5 to 38 wefts per cm |
| Repeat: | 1/48 |
| Number of shafts: | maximum of 16 |
| Motor: | 2 HP brake motor with inching speed |

The high speed automatic narrow loom machine is a 4 piece loom that has a very high output needle loom for a variety of fabrics.

A fabric yarn is provided on suitable rolls and fed into the automatic narrow loom machine. An operator sets the pattern on the machine such that the yarn is weaved into an integral roll of narrow fabric material such that a pair of longitudinally extending pockets are formed on the outer edges of the material. The rearrangement of specific frames on the machine to give a suitable warp and weft insertion provides the means by which the yarn is suitably weaved into integrally formed pockets. The roll of narrow fabric material comprising the longitudinally extending pockets is collected on a roll in long lengths up to 1000 m.

Suitable fabric yarns include polyester or acrylic yarn, nylon, cotton, wool, polypropylene and any other fabric suitable for use in fabric blinds.

The rolls of narrow fabric material comprising the longitudinally extending pockets are then fed into a suitable colouring and finishing machine by which colours and an acrylic coating are provided to the narrow fabric material. The rolls of narrow fabric material are firstly dipped into a vat which has rollers to wring out excessive colour in the fabric.

The fabric material is then transported by a conveyor belt through a pre-drying process which heat sets the colour and hardens the acrylic coating by placing in an oven at a temperature of 150 to 200 degrees Celsius.

The rolls of narrow fabric material, once dryed, are collected on a roll. The roll of coloured and treated fabric material is then cut into suitable lengths for different sized slats. The appropriate holes are also punched into the slat for ladder tapes and/or cord for a venetian blind.

Once, the material is cut into suitable lengths, a relatively rigid material rod is inserted into the longitudinally extending pockets.

Conventional venetian blind headboxes, ladder tapes and /or cords are provided such that the fabric venetian blind is formed.

Alternatively, an automatic knitting machine may be utililised to make the blind slat of the present invention and which may also knit additional shaping to each longitudinal edge. A fabric yarn is provided on suitable rolls and fed into the automatic knitting machine. An operator sets the pattern on the machine such that the yarn is knitted into an integral roll of narrow fabric material such that a pair of longitudinally extending pockets are formed on the outer edges of the material. The rearrangement of specific frames on the machine to give a suitable warp and weft insertion provides the means by which the yarn is suitably knitted into integrally formed pockets. The roll of narrow fabric material comprising the longitudinally extending pockets is collected on a roll in long lengths up to 1000 m.

The automatic knitting machine achieves the formation of the longitudinally extending pocket by the insertion of a flexible spacer element. The spacer element is substituted in the automatic knitting machine for an automatic needle which is removed. The automatic knitting machine by way of rearrangement of specific frames to provide a suitable warp and weft insertion pattern sews an integrally formed pocket around the spacer element. The spacer element may be any suitable elongated length of a fabric cord.

Suitable fabric yarns include polyester or acrylic yarn, nylon, cotton, wool, polypropylene and any other fabric suitable for use in fabric blinds.

An advantage of the automatic knitting machine is that additional shapes such as scolloped edges may be knitted on the longitudinal edges 16 and 18 of the fabric blind slat 10.

The rolls of narrow fabric material comprising the longitudinally extending pockets are then fed into a suitable colouring and finishing machine by which colours and an acrylic coating are provided to the narrow fabric material. The rolls of narrow fabric material are firstly dipped into a vat which has rollers to wring out excessive colour in the fabric.

The fabric material is then transported by a conveyor belt through a pre-drying process which heat sets the colour and hardens the acrylic coating by placing in an oven at a temperature of 150 to 200 degrees Celsius.

The rolls of narrow fabric material, once dryed, are collected on a roll. The roll of coloured and treated fabric material is then cut into suitable lengths for different sized slats. The appropriate holes are also punched into the slat for ladder tapes and/or cord for a venetian blind.

Once the narrow fabric material is cut into the desired lengths of the slat 10, one end of the spacer element is threaded and secured into one end of the relatively rigid support member 24. The spacer element is pulled from the other end thereby inserting the support member 24 into the longitudinally extending pockets 14. This process is repeated for each longitudinal pocket containing the spacer element.

The example of the present invention only serves to describe preferred embodiments of the invention and other methods of forming the longitudinally extending pockets by way of sewing a hem or knitting the longitudinally extending pockets are within the spirit and scope of the present invention.

As discussed hereinabove, it is envisaged that fabric blind slats including longitudinal pockets could be modified into different shapes such that scolloped edges could be knitted along the longitudinal edge to provide further aesthetic appeal to the fabric blind.

Modifications and variations such as would be apparent to a skilled addresee are deemed to be within the scope of the present invention.

I claim:

1. A fabric venetian blind slat comprising an elongated strip of fabric having a central strip with opposed longitudinal edges, a respective longitudinally extending pocket on each longitudinal edge, and a respective relatively rigid support member inserted into each longitudinally extending pocket, wherein each longitudinally extending pocket is integrally formed with the central strip and, in cross section, has a seamless endless periphery, and each relatively rigid support member is removably inserted in the respective longitudinally extending pocket.

2. A fabric venetian blind slat in accordance with claim 1, wherein each longitudinally extending pocket is made of the same fabric material as the central strip of fabric.

3. A fabric venetian blind slat in accordance with claim 1, wherein the elongated strip of fabric is made from polyester, nylon, cotton, wool, polypropylene, acrylic material or a mixture thereof.

4. A fabric venetian blind slat in accordance with claim 1, wherein the relatively rigid support member is made from fiberglass, metal, wood, polyvinyl chloride, nylon or other plastics material.

5. A fabric venetian blind slat in accordance with claim 1, wherein the relatively rigid support member is resilient.

6. A fabric venetian blind assembly including:

(a) a plurality of fabric venetian blind slats each comprising an elongated strip of fabric having a central strip with opposed longitudinal edges, a respective longitudinally extending pocket on each longitudinal edge, and a respective relatively rigid support member inserted into each longitudinally extending pocket, wherein each longitudinally extending pocket is integrally formed with the central strip and, in cross section, has a seamless endless periphery, and each relatively rigid support member is removably inserted in the respective longitudinally extending pocket;

(b) a connecting ladder rope or a connecting tape;

(c) a venetian blind head box; and (d) one or more draw cords.

7. A fabric venetian blind assembly in accordance with claim 6, wherein each longitudinally extending pocket is made of the same fabric material as the central strip of fabric.

8. A fabric venetian blind assembly in accordance with claim 6, wherein the strip of fabric is made from polyester, nylon, cotton, wool, polypropylene, acrylic material or mixture thereof.

9. A fabric venetian blind assembly in accordance with claim 6, wherein the relatively rigid support member is made from fiberglass, metal, wood, polyvinyl chloride, nylon or other plastics material.

10. A fabric venetian blind assembly in accordance with claim 6, wherein the relatively rigid support member is resilient.

11. A method for the assembly of a fabric venetian blind including the following steps:

(a) forming a fabric venetian blind slat comprising an elongated strip of fabric having a central strip with opposed longitudinal edges, a respective longitudinally extending pocket on each longitudinal edge, and a respective relatively rigid support member inserted into each longitudinally extending pocket, wherein each longitudinally extending pocket is integrally formed with the central strip and, in cross section, has a seamless endless periphery, and each relatively rigid support member is removably inserted in the respective longitudinally extending pocket; and (b) connecting the fabric blind slats by way of a connecting ladder rope or a tape.

12. A method for the production of a fabric venetian blind assembly in accordance with claim 11, wherein in that the fabric blind slat is formed in step (a) by way of an automatic needle loom machine.

13. A method for the production of a fabric venetian blind assembly in accordance with claim 11, wherein the fabric blind slat is formed in step (a) by way of an automatic knitting machine.

* * * * *